United States Patent [19]

Krause et al.

[11] Patent Number: 4,620,186

[45] Date of Patent: Oct. 28, 1986

[54] MULTI-BIT WRITE FEATURE FOR VIDEO RAM

[75] Inventors: Charles A. Krause, Stevensville; Babu Rajaram, St. Joseph, both of Mich.

[73] Assignee: Zenith Electronics Corporation, Glenview, Ill.

[21] Appl. No.: 527,943

[22] Filed: Aug. 30, 1983

[51] Int. Cl.[4] ..... G09G 1/28

[52] U.S. Cl. ..... 340/703; 340/747; 340/750; 340/798

[58] Field of Search ..... 340/701, 703, 723, 798, 340/799, 711, 750, 747

[56] References Cited

U.S. PATENT DOCUMENTS

| | | | |
|---|---|---|---|
| 3,928,845 | 12/1975 | Clark | 340/799 |
| 4,026,555 | 5/1977 | Kirschner et al. | 340/799 |
| 4,092,728 | 5/1978 | Baltzer | 340/799 |
| 4,342,029 | 7/1982 | Hofmanis et al. | 340/799 |
| 4,451,824 | 5/1984 | Thayer et al. | 340/720 |
| 4,468,814 | 8/1984 | Field | 340/701 |

*Primary Examiner*—Marshall M. Curtis

[57] ABSTRACT

In a video display system having a video random access memory (RAM) including a plurality of color memory banks, with one memory bank for each of the primary colors, provision is made for simultaneously writing to all of the color banks. A central processor unit (CPU) places data onto the system bus and asserts $\overline{WRT}$-$\overline{R}$, $\overline{WRT}$-$\overline{G}$ and/or $\overline{WRT}$-$\overline{B}$ signals in selectively writing at the same time to any or all of the video RAM banks, where the primary colors are red, green and blue. Logic circuitry coupled to the three RAM banks then gates designated Row and Column Address Strobe (RAS and CAS) signals to each of the color arrays followed by color video data signals. The time required to thus write video display information into the multi-bank video RAM array is thus reduced and system video data throughput correspondingly increased.

1 Claim, 1 Drawing Figure

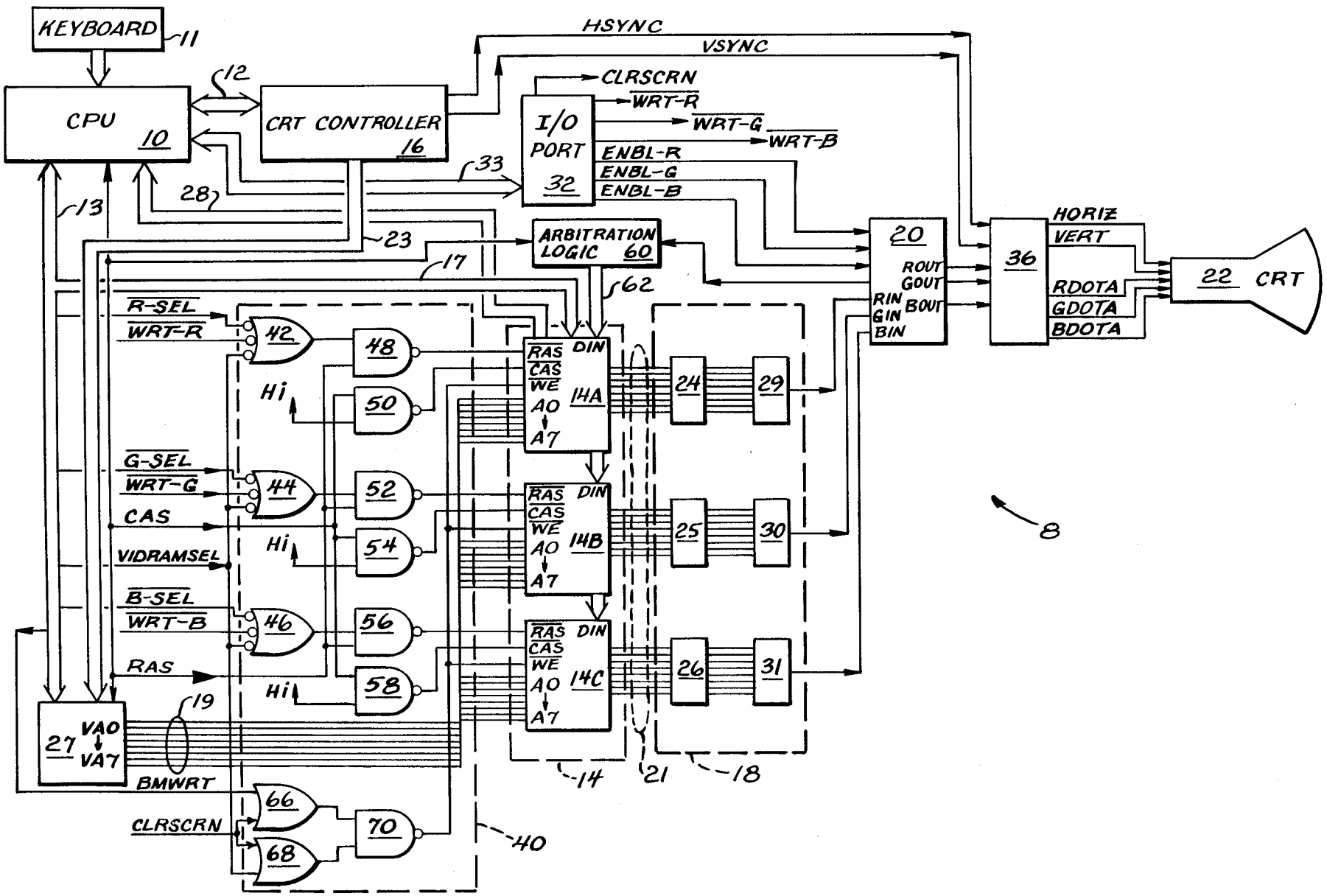
CRT
22
HORIZ
VERT
RDOTA
GDOTA
BDOTA
36
8
20
ROUT
GOUT
BOUT
RIN
GIN
BIN
VSYNC
HSYNC
CLRSCRN
WRT-R
WRT-G
WRT-B
ENBL-R
ENBL-G
ENBL-B
I/O PORT
32
ARBITRATION LOGIC
60
62
29
30
31
24
25
26
18
21
14
DIN
14A
14B
14C
RAS
CAS
WE
A0
A7
40
CRT CONTROLLER
16
33
17
23
48
50
52
54
56
58
70
42
44
46
66
68
Hi
12
28
11
KEYBOARD
CPU
10
13
R-SEL
WRT-R
G-SEL
WRT-G
CAS
VIDRAMSEL
B-SEL
WRT-B
RAS
19
BMWRT
CLRSCRN
VA0
VA7
27

MULTI-BIT WRITE FEATURE FOR VIDEO RAM

CROSS-REFERENCE TO RELATED APPLICATIONS

This application is related to but in no way dependent upon the following applications which are assigned to the assignee of the present application: Ser. No. 446,296, filed Mar. 21, 1983, entitled "Video RAM Acessing System," in the name of Babu Raqaram and issued as U.S. Pat. No. 4,511,965 on Apr. 16, 1985; and Ser. No. 527,974, filed Aug. 30, 1983, entitled "Selective Page Disable For A Video Display", in the names of Charles A. Krause and Babu Rajaram.

BACKGROUND OF THE INVENTION

This invention relates generally to video display systems and in particular is directed to a color video display system having a plurality of memory banks, each storing data directed to a primary color.

Information systems which provide graphic images of geometric figures, alphanumeric characters and various other symbols for display on a screen are known a graphic, or video display, terminals. One type of video display terminal is provided with a cathode ray tube (CRT) having a very low persistence such that it is necessary to add an erasable image memory where the data of the image are stored and may be read repetitively therefrom under the control of a CRT controller in accordance with an operating program stored in a central processor unit (CPU) in order to refresh the displayed image. Because of the need, in generating a cathode ray tube video display, to continually and repetitively refresh the information written on the display, a writable memory such as a random access memory (RAM) having a discrete addressable location for each character to be displayed on the video screen is typically utilized. The video RAM is a read and write memory into which video information is written by the CPU and from which digital data is sequentially read synchronously with the raster scan of the CRT under the control of a CRT controller in accordance with operating instructions stored in the CPU. This video RAM is sequentially addressed to provide a sequence of digital words identifying the alphanumeric characters or other symbols to be visually displayed at successive character locations on the screen.

A color video display typically employs a plurality of refresh memory banks, each representing data corresponding to a primary color. For example, a common arrangement utilizes red, green and blue video memory banks, in which the data stored therein may be selectively accessed in various combinations to provide a full color spectrum. For example, a white symbol may be generated by simultaneously providing information from each of the green, red and blue memory banks to the video display.

In prior art video display systems, each color memory bank is accessed consecutively, or sequentially, by the CPU for writing video data therein. This, of course, imposes upon the CPU additional time during which its operation must be dedicated to providing video information to the video RAM. As a result, the CPU is unable to perform other graphic terminal functions during this period resulting in rather inefficient use of the CPU in the video display system. In addition, the video information displayed on the CRT may only be updated after all color banks are accessed which imposes another limitation upon the quality of the video image and the operating flexibility of the video display terminal.

Accordingly, the present invention is intended to overcome the aforementioned limitations of the prior art by providing an arrangement for simultaneously writing video data into two or more video RAM banks from a CPU in a microprocessor controlled video display system. Each of the video RAM banks represents a primary color, with the video data update time minimized by this simultaneous video RAM access arrangement in providing increased time for other CPU oprations.

OBJECTS OF THE INVENTION

Accordingly, it is an object of the present invention to provide improved color gràphics in a video display system.

It is another object of the present invention to provide for more rapid updating of video data displayed on a microprocessor controlled color video display.

Yet another object of the present invention is to provide increased data throughput in a multi-memory bank color video display system.

BRIEF DESCRIPTION OF THE DRAWING

The appended claims set forth those novel features believed characteristic of the invention. However, the invention itself, as well as further objects and advantages thereof, will best be understood by reference to the following detailed description of a preferred embodiment taken in conjunction with the accompanying drawing, in which is shown in simplified block diagram form an arrangement for providing a simultaneous multi-bit write feature for a plurality of video RAM arrays in a color video display system.

DESCRIPTION OF THE PREFERRED EMBODIMENT

Referring to the FIGURE, there is shown in simplified block diagram form a multi-bit write system 8 for simultaneously writing video information into the several memory banks, or planes, of a color video display.

User initiated inputs are provided to a central processing unit (CPU) 10 by means of a conventional input device such as a keyboard 11. The microprocessor utilized in a preferred embodiment of the present invention is the 8-bit HMOS 8088 microprocessor available from Intel Corporation of Santa Clara, Calif. This microprocessor includes an 8-bit data bus interface which can address up to a maximum of 1 megabyte of memory. The 8088 microprocessor is conventional in design and operation and thus representative of the typical 8-bit microprocessor currently available. Thus, the present invention is not limited in its application to the use of the 8088 microprocessor, nor is it limited in operation to an 8-bit microprocessor, but will operate equally well with any conventional microprocessor regardless of word length.

CPU 10 is coupled to a video RAM array 14 via a system bus 13, an address multiplexer 27, a simultaneous multi-bit write circuit 40, and data and address buses 17, 19, respectively. CPU 10 is capable of either writing data into or reading data from the video RAM array 14. Similarly, a CRT controller 16 is coupled to the video RAM array 14 via a CRT controller address bus 23, address multiplexer 27 and address bus 19. Unlike CPU 10, the CRT controller 16 is only capable of providing addresses to the video RAM array 14 so that video information can be read therefrom. CPU 10 and the video RAM array 14 are also coupled to an arbitration logic unit 60 and are responsive to control signals output therefrom for selectively coupling either CPU 10 or CRT controller 16 to the video RAM array 14. The manner in which CPU 10 and CRT controller 16 are sequentially coupled to the video RAM array 14 is described in co-pending application entitled "Video Ram Accessing System", filed in the name of Babu Rajaram, assigned to the assignee of the present invention, and hereby incorporated by reference in the present application.

A bi-directional data/control bus 12 couples the CPU 10 to the CRT controller 16. Thus, under the direction of CPU 10, the CRT controller 16 selectively reads the contents of the video RAM array 14 in providing appropriate data inputs via the data OUT bus 21 to the combination of video latch 18 and video logic 20 in driving the CRT 22.

The CRT controller 16 utilized in a preferred embodiment of the present invention is the HD6845 CRT controller available from Hitachi America, Ltd. In selectively reading the contents of the video RAM array 14 under the control of the CPU 10, the CRT controller 16 provides for the appropriate 8-bit output signals to the video latch 18 via the data OUT bus 21. The CRT controller 16 continuously updates the video display presented on CRT 22 60 times per second based upon the contents of the addressed locations in the video RAM array 14. The CRT controller 16 generates a video RAM address signal and reads a byte representing 8 pixels on the CRT's screen from the video RAM array 14. Once these pixels are displayed, the CRT controller 16 automatically, depending upon its initialization parameters, advances to the next byte describing the next group of 8 pixels with this process continuing without interruption.

The control/data signals transmitted via CPU data control bus 12 connecting the CPU 10 and the CRT controller 16 specify such system parameters as CRT type, lines per screen to be displayed on the CRT, characters per line and interrupt generation during the vertical sync interval. From the FIGURE, it can be seen that control and data signals are provided between the video RAM array 14 and both the CPU 10 and the CRT controller 16.

The timed output of a character clock (not shown) is provided to the clock input of the CRT controller 16 for synchronizing horizontal and vertical sweep with the display of characters on the CRT 22. HSYNC and VSYNC signals provided from CRT controller 16 to a hex D-type flip-flop circuit 36 insure that the first displayed dot, or pixel, occurs at the first character location on the faceplate of CRT 22. Also provided to CRT 22 via flip-flop circuit 36 from a video logic circuit 20 are color dot signals in which is provided video image information.

Under the control of user instructions provided to the CPU 10 and in accordance with operating program instructions stored therein, the CRT controller 16 reads graphic information from the video RAM array 14 in providing video data to CRT 22 for display thereon. In a preferred embodiment the video RAM array 14 includes three memory banks 14A, 14B and 14C, each 64K×8 bits for respectively storing red, green and blue color data. The organization of the video RAM array 14 is shown in Table I.

Each of the three video banks, or planes, 14A, 14B and 14C resides in a distinct 64K byte segment in the video RAM array 14. The red plane 14A is at address E0000H, the green plane 14B is at address D0000H, and the blue plane 14C is at address C0000H. In a black and white system only the green plane, which is of highest intensity, is utilized.

Under the control of user instructions provided to CPU 10 and in accordance with operating program instructions stored therein, the CRT controller 16 reads graphic information from the video RAM array 14 in providing video data to CRT 22 for display thereon. The CRT controller 16 reads bytes from each of the green, red and blue video RAMs 14A, 14B and 14C, and provides this data to respective latches 24, 25 and 26 in the video latch circuit 18. The latched outputs of latches 24, 25 and 26 are, in turn, provided to green, red and blue shift registers 29, 30 and 31 for serially shifting respective color data into the video logic circuit 20 in the form of RIN, GIN and BIN color signals.

TABLE I

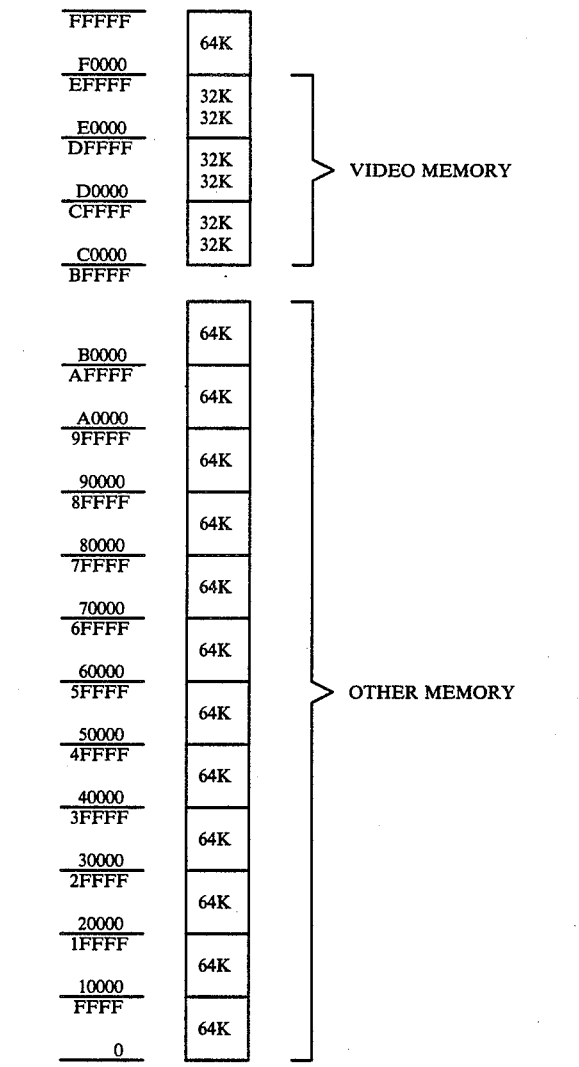

Each character displayed on CRT 22 is defined by an 8×9 pixel matrix. Thus in a color display, 8-bits are read from each of video RAM banks 14A, 14B and 14C and are provided in parallel to the red, green and blue latches 24, 25 and 26. The 8-bit bytes of color video information are then loaded in parallel to respective shift registers 29, 30 and 31 in accordance with a DOTCLK signal provided to the respective clock inputs thereof by a system clock (not shown). The thus serially shifted data is then provided in the form of the aforementioned RIN, GIN and BIN color signals to the video logic circuit 20.

When video information from the video RAM array 14 is to be displayed on CRT 22, color enable signals are provided from CPU 10 via a data bus 33 to a parallel input/output (I/O) port 32. In response to these color enable signals, I/O port 32 outputs ENBL-R, ENBL-G, and ENBL-B enable signals to the video logic circuit 20 for the display of color video information in accordance with the program being executed by CPU 10. I/O port 32 thus functions as an interface adapter between CPU 10 and video logic circuit 20 in the providing two 8-bit bidirectional peripheral data buses and four control lines between these two devices. In a preferred embodiment, the Motorola MC68A21 peripheral interface adapter (PIA) chip is utilized for I/O port 32, while the video logic circuit 20 is comprised of a 14H4 programmable array logic (PAL) integrated circuit (IC) available from Monolithic Memories, Inc. The PAL device is comprised of a plurality of AND and OR logic gates (not shown) for processing the various signals provided thereto in driving CRT 22. The configuration and operation of video logic circuit 20 in a preferred embodiment of the present invention is described in co-pending application "Selective Page Disable for a Video Display", filed in the name of the present inventors, assigned to the assignee of the present application, and hereby incorporated by reference in the present application.

In response to the various color signals provided to video logic circuit 20, various color outputs ROUT, GOUT, and BOUT are provided from video logic circuit 20 to flip-flop circuit 36. In addition, the synchronization pulses HSYNC and VSYNC are provided to flip-flop circuit 36. The ROUT, GOUT, and BOUT signals as well as the HSYNC and VSYNC timing signals are synchronized with a DOTCLK signal in insuring that the first color dot occurs at the first character location on the faceplate of CRT 22. The thus sychronized HORIZ and VERT sweep signals as well as the RDOTA, GDOTA, and BDOTA color signals are asserted to CRT 22 from flip-flop circuit 36 in synchronization with the occurrence of the DOTCLK timing signal provided to the CLK input of flip-flop circuit 36. Flip-flop circuit 36 corrects for any propagation delays in the various signal paths in providing synchronized sweep and color video signals to CRT 22.

The multi-bit write system 8 of the present invention further includes an arbitration logic circuit 60 for controlling CPU 10 and CRT controller 16 access to the video RAM array 14. Arbitration logic circuit 60 in a preferred embodiment is a programmable array logic (PAL) integrated circuit from the PAL 14L4 family of programmable array logic devices manufactured by Monolithic Memories of Sunnyvale, Calif. The arbitration logic circuit 60 is responsive to three input signals: a video RAM "read" signal (MEMRD), a video RAM array "write" signal (MEMWRT), and a CRT video RAM array "select" signal ($\overline{\text{CRTRAMSEL}}$). The MEMRD signal indicates that the video RAM array 14 is in a data read cycle wherein information is provided to CPU 10 via a data OUT bus 28 from the video RAM array 14. The MEMWRT input signal indicates that the video RAM array 14 is in a write cycle wherein video information may be written into the video RAM array 14 by CPU 10. The $\overline{\text{CRTRAMSEL}}$ signal indicates to the arbitration logic circuit 60 that the CPU 10 seeks access to the video RAM array 14. These three signals are provided to the arbitration logic circuit 60 and represent those signals generated in a data processing system having a video display and may be generated by conventional means in the present invention. For example, these signals could be provided by the video logic circuit 20 by monitoring a predetermined address location in the video RAM array 14 and outputting selected signals when that particular location is being addressed by the CPU 10. By thus providing the three aforementioned signals to the arbitration logic circuit 60, information regarding the operating status of the video RAM array 14 and whether or not CPU 10 desires access to the video RAM array 14 is generated in the present invention.

A VIDRAMSEL signal is provided from CPU 10 via system bus 13 to a simultaneous multi-bit write logic circuit 40 in accordance with the present invention. In addition, column address strobe (CAS) and row address strobe (RAS) signals are provided from the arbitration logic circuit 60 to the multi-bit write logic circuit 40. The arbitration logic circuit 60 also provides an ADMUX signal to address multiplexer 27 for multiplexing video RAM address information with the row and column address signals (RAS and CAS) to the video RAM array 14. The RAS and CAS signals are necessary for the operation of the dynamic RAM utilized as the video RAM array 14 in the present invention. The start of a $\overline{\text{RAS}}$ signal represents the start of a memory access cycle while the falling edge of the $\overline{\text{RAS}}$ signal initiates latching of the appropriate row address information into the video RAM array 14. Similarly, the falling edge of the $\overline{\text{CAS}}$ signal initiates the reading of appropriate column addressing information into the video RAM array 14. Since in the present invention a 64K dynamic RAM is used as the video RAM array 14, 16-bits of address are provided thereto by the CRT controller 16. Because the dynamic RAM includes only 8 input pins, the 16-bits of information must be multiplexed onto these input pins and this is accomplished by means of the ADMUX signal which multiplexes these 16-bits of information onto the 8 input pins of the video RAM array 14.

A RAS signal provided from the arbitration logic circuit 60 to multi-bit write circuit 40 initiates the start of a video RAM array accessing cycle. The RAS signal is followed by the CAS signal, with the ADMUX signal interposed therebetween for properly sequencing these signals into the video RAM array 14. The RAS and CAS signals provide the proper addressing information to the video RAM array 14 in providing selected video information to the CRT 22.

The VIDRAMSEL signal is provided from CPU 10 via system bus 13 to OR gate 68 in the simultaneous multi-bit write circuit 40. In addition, the BMWRT signal is provided to one input of OR gate 66 from the system bus 13. A normally low CLRSCRN signal is similarly provided from the I/O port 32 to respective inputs of OR gates 66, 68. The outputs of OR gates 66, 68 are provided to respective input pins of NAND gate 70 for asserting a write enable ($\overline{\text{WE}}$) signal at the output pin thereof to each of red, green and blue memory banks 14A, 14B and 14C. The $\overline{\text{WE}}$ input will be asserted to each of these memory banks when both the BMWRT and VIDRAMSEL signals are asserted, i.e., when the CPU 10 is writing information to the video RAM array 14. The BMWRT signal is thus used to write data into the video RAM array 14. Assertion of an active low $\overline{WE}$ input to each of the aforementioned RAM banks 14A, 14B and 14C prepares each memory array for the writing of video information therein.

CPU 10 generates R-SEL, G-SEL and B-SEL signals for selecting any or all of red, green and blue RAM banks 14A, 14B and 14C. These R-SEL, G-SEL and B-SEL signals are provided via system bus 13 from CPU 10 to one input pin of each of OR gates 42, 44, and 46. To another input pin of each of OR gates 42, 44 and 46 is provided the VIDRAMSEL signal from the CPU 10 via system bus 13. Finally, WRT-R, WRT-G, and WRT-B signals are provided by I/O port 32 to a third input pin of each of OR gates 42, 44 and 46.

When the VIDRAMSEL signal is low, the CRT controller 16 is accessing the video RAM array 14. Since the VIDRAMSEL signal is provided to all three of OR gates 42, 44 and 46, a low VIDRAMSEL signal causes the outputs of all three of the aforementioned logic gates to go high enabling the $\overline{RAS}$ signal to the red, green and blue memory banks 14A, 14B and 14C. Thus, all three of the red, green and blue memory banks 14A, 14B and 14C are simultaneously accessed by the CRT controller 16 in reading video information therefrom and providing it to CRT 22.

When CPU 10 accesses the video RAM array 14, the VIDRAMSEL signal is high and is not involved in enabling the $\overline{RAS}$ signal to the respective color memory banks. Similarly, if the WRT-R, WRT-G, and WRT-B signals are all high, these signals will also not be involved in enabling the $\overline{RAS}$ signal to each of the color memory arrays.

Thus, when CPU 10 is writing to the red RAM bank 14A, it will assert a R-SEL to OR gate 42 causing its output to go high. However, the outputs of OR gates 44, 46 will remain low since the G-SEL and B-SEL have not been asserted by the CPU 10 to these logic gates. Under these conditions, CPU 10 will write to only the red RAM bank 14A because the $\overline{RAS}$ signal has not been asserted to the green and blue RAM banks 14B, 14C and a memory write cycle has thus not been initiated with respect to these latter two memory banks.

The $\overline{WE}$ and $\overline{CAS}$ signals are also common to each of the color RAM banks 14A, 14B and 14C. The $\overline{CAS}$ signal is provided via NAND gates 50, 54 and 58 to a respective color RAM array. Similarly, as previously explained, a $\overline{WE}$ input to each of the respective color RAM arrays is provided via the combination of OR gates 66, 68 and NAND gate 70 in response to BMWRT, CLRSCRN, and VIDRAMSEL signals provided thereto.

If CPU 10 sets the WRT-B bit low, i.e., the "write blue also" feature has been turned on, when the CPU 10 writes to the red RAM bank 14A, the R-SEL signal will be asserted and the same sequence of events as described above will take place. However, in this case the blue RAM bank 14C is not selected, i.e., B-SEL is high since the CPU 10 can access only one color RAM bank at a time and R-SEL is active. Because WRT-B is active, i.e., low, the output of OR gate 46 will go high, thus enabling the $\overline{RAS}$ signal to the blue RAM bank 14C.

Thus, CPU 10, while writing data into the RED RAM bank 14A, has simultaneously written the same data into the blue RAM bank 14C in the corresponding location therein. If the WRT-G signal were also simultaneously active, then data would be written also to the green RAM bank 14B. It is in this manner that video data may be simultaneously written by CPU 10 into each of the red, green and blue RAM banks 14A, 14B and 14C. It is to be noted that the WRT-R signal need not be active since CPU 10 can select the red RAM bank 14A by means of the R-SEL signal.

Similarly, the CAS signal is provided to one input of each of NAND gates 50, 54 and 58 from the arbitration logic circuit 60. The other input pin of each of these NAND gates is pulled high in permitting it to operate as an inverter with respect to the CAS signal for providing a $\overline{CAS}$ signal from arbitration logic circuit 60 via multibit write circuit 40 to any of the red, green or blue memory banks 14A, 14B or 14C. The falling edge of the $\overline{CAS}$ signal initiates the reading of appropriate column addressing information into a respective one of color memory banks 14A, 14B or 14C. It is in this manner that video information may be written simultaneously into each of red, green and blue memory banks 14A, 14B and 14C from CPU 10.

The RAS portion of the video RAM array address is first placed on lines VA0–VA7 by address multiplexer 27. After the RAS line information is gated through to the video RAM array 14, CAS address information is then placed on address lines VA0–VA7 and this information is then provided to the appropriate color bank(s). Only the color bank(s) previously selected by a $\overline{RAS}$ signal will be affected by the subsequently generated $\overline{CAS}$ signal. Color data is then written by CPU 10 into the appropriate memory locations in any one, or all, of color memory banks 14A, 14B and 14C via data bus 17.

There has thus been shown an arrangement in a video display system for simultaneously writing video information into a plurality of color memory banks, or memory arrays, in which is stored respective primary color display data. A CPU places data onto a system bus and asserts appropriate control instructions to any or all of the color memory banks for selectively writing video information therein at the same time. Logic circuitry coupled to each of the memory banks generates appropriate row and column address strobe signals as well as WRITE commands for each of the respective color memory banks.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In a raster scanned color video display system comprised of a video display unit having a matrix of discrete picture elements and three memory banks coupled thereto for the storage of primary color video data therein representing a respective primary color component of each of said discrete picture elements, wherein each memory bank is comprised of a plurality of memory locations arranged in a matrix format and wherein each memory location is designated by a unique row and column address combination, means for simultaneously writing said primary color video data into two or more of said plurality of memory banks comprising:

a central processor unit coupled to each of said memory banks by means of a data bus for writing a respective primary color component of each of said discrete picture elements into each of said memory banks;

a control unit coupled to each of said memory banks and to said central processor unit, for reading said primary color video data therefrom and providing said data to said video display unit;

first logic means coupled to said central processor unit and to each of said plurality of memory banks for alternately coupling said central processor unit and said control unit to said plurality of memory banks for writing said video data into and reading said video data out of said memory banks and for alternately generating row and column address signals; and second logic means coupling each of said memory banks in parallel to said central processor unit and responsive to memory bank select signals output therefrom representing each of said respective memory banks for simultaneously coupling said central processor unit to two or more of said plurality of memory banks wherein said primary color video data is provided in parallel to two or more of said memory banks at the same time, said second logic means further coupled to said first logic means for providing said row and column address signals to each of said memory banks simultaneously.

* * * * *